US006412791B1

(12) United States Patent
Chu

(10) Patent No.: US 6,412,791 B1
(45) Date of Patent: Jul. 2, 2002

(54) ROLLER SKATE WITH RECEIVABLE WHEEL DESIGN

(76) Inventor: Wei-Yen Chu, No. 261, Ta Chu Road, Lu Chu Hsiang,Tao-Yuan Hsien (TW)

( * ) Notice: Subject to any disclaimer, the term of this patent is extended or adjusted under 35 U.S.C. 154(b) by 0 days.

(21) Appl. No.: 09/756,134

(22) Filed: Jan. 9, 2001

(51) Int. Cl.[7] ..... A63C 17/00

(52) U.S. Cl. ..... 280/11.19; 280/7.13; 280/9; 280/11.211; 36/115

(58) Field of Search ..... 280/7.13, 9, 11.206, 280/11.208, 11.211, 11.217, 7.11, 7.12, 825; 36/115

(56) References Cited

U.S. PATENT DOCUMENTS 2,095,942 A * 1/1937 Wetterstrand ..... 280/11.227
3,352,353 A * 11/1967 Weitzner ..... 165/41
3,983,643 A * 10/1976 Schreyer et al. ..... 280/11.19
4,928,982 A * 5/1990 Logan ..... 280/11.221
5,797,609 A * 8/1998 Fichepain ..... 280/11.19
5,803,469 A * 9/1998 Yoham ..... 280/11.27
6,120,039 A * 9/2000 Clementi ..... 280/11.19
6,247,708 B1 * 6/2001 Hsu ..... 280/11.223
6,308,964 B1 * 10/2001 Chang ..... 280/11.19

FOREIGN PATENT DOCUMENTS

CH 000610206 A * 4/1979 ..... 280/7.13

* cited by examiner

*Primary Examiner*—Brian L. Johnson
*Assistant Examiner*—Kelly E Campbell
(74) *Attorney, Agent, or Firm*—Rosenberg, Klein & Lee

(57) ABSTRACT

A roller skate includes a sole plate holding two wheel holders and a stop holder in front and rear receiving chambers in an outsole, two wheel assemblies respectively pivoted to the wheel holders and turned between an extended position extended out of the outsole for skating and a received position received inside the outsole for enabling the roller skate to function as a normal shoe for walking, lock control means adapted to lock the wheel assemblies between the extended position and the received position, and a stop alternatively set in a stop holder at the back side of one wheel holder between the working position and the non-working position.

6 Claims, 7 Drawing Sheets

ROLLER SKATE WITH RECEIVABLE WHEEL DESIGN

BACKGROUND OF THE INVENTION

The present invention relates to roller skates and, more particularly, to a roller skate with receivable roller design in which the rollers can be received inside the outsole of the boot, enabling the boot to work as a regular shoe for walking.

Various roller skates have been disclosed, and have appeared on the market. There is known a roller skate that can be set between two modes, namely, the skating mode and the walking mode. This structure of roller skate, as shown in FIG. 1, comprises a shoe body, roller means 7 mounted in the outsole of the shoe body and alternatively set between the extended position and the received position. The receiving chamber 8 of the outsole for receiving the roller means 7 is an open chamber in which dust and mud tend to be accumulated. Further high-strength spring means is provided at the pivot shaft 71 of the roller means 7 to hold the roller means 7 in position. When changing the roller means 7 from the received position to the extended position, much effort should be employed. Further, this structure of roller skate has no brake means for stopping the roller skate from running.

SUMMARY OF THE INVENTION

It is one object of the present invention to provide a roller skate, which can be set between the skating mode and the walking mode. It is another object of the present invention to provide a roller skate, which keeps the outsole from dust when set in the walking mode. It is still another object of the present invention to provide a roller skate, which can easily conveniently be set between the skating mode and the walking mode. According to the present invention, the roller skate comprises a sole plate holding two wheel holders and a stop holder in front and rear receiving chambers in an outsole, two wheel assemblies respectively pivoted to the wheel holders and turned between an extended position extended out of the outsole for skating and a received position received inside the outsole for enabling the roller skate to function as a normal shoe for walking, lock control means adapted to lock the wheel assemblies between the extended position and the received position, and a stop alternatively set in a stop holder at the back side of one wheel holder between the working position and the non-working position.

DETAILED DESCRIPTION OF THE PREFERRED EMBODIMENT

Figure 1:
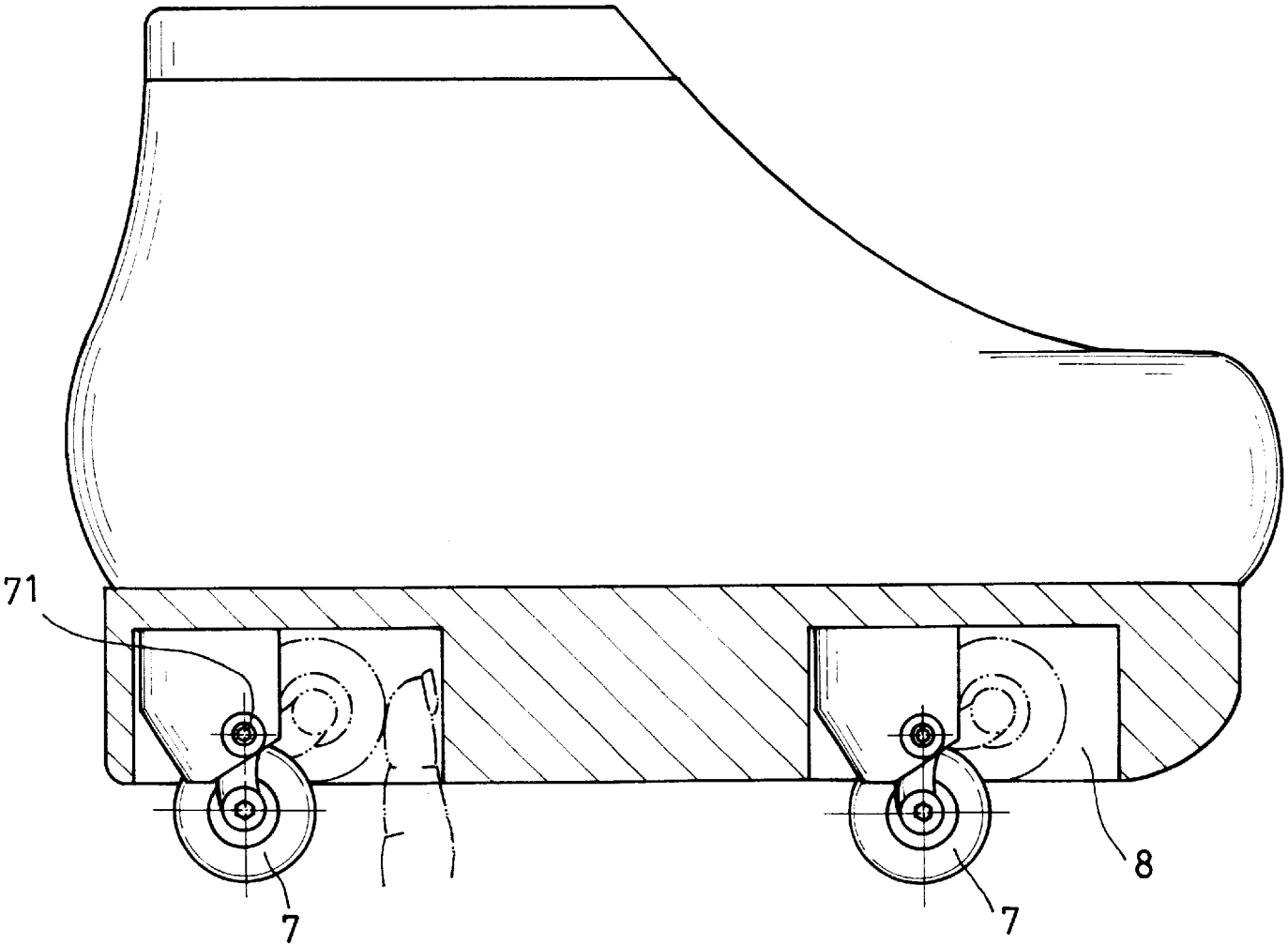
FIG. 1 PRIOR ART
FIG. 1 illustrates a roller skate according to the prior art.
Figure 2:
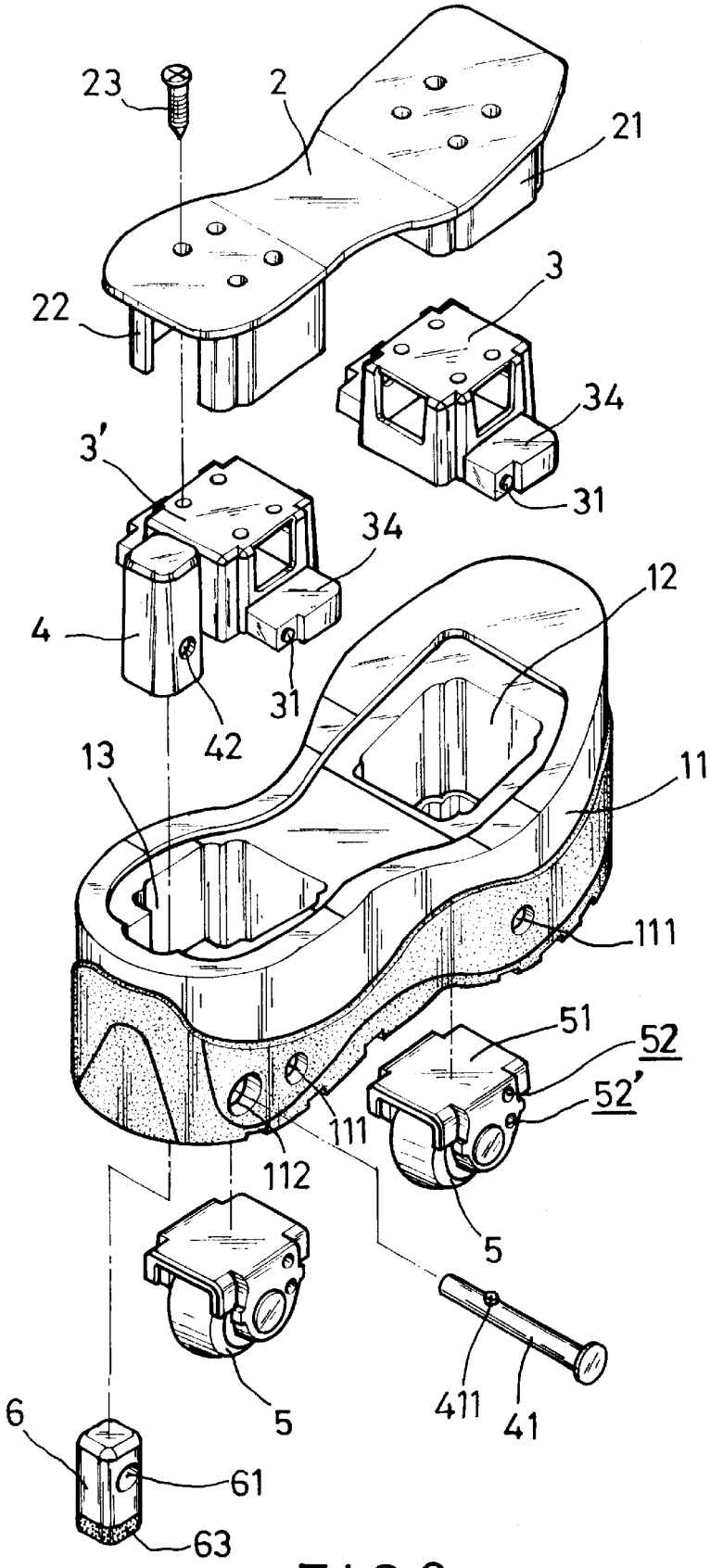
FIG. 2 is an exploded view of the present invention.
Figure 3:
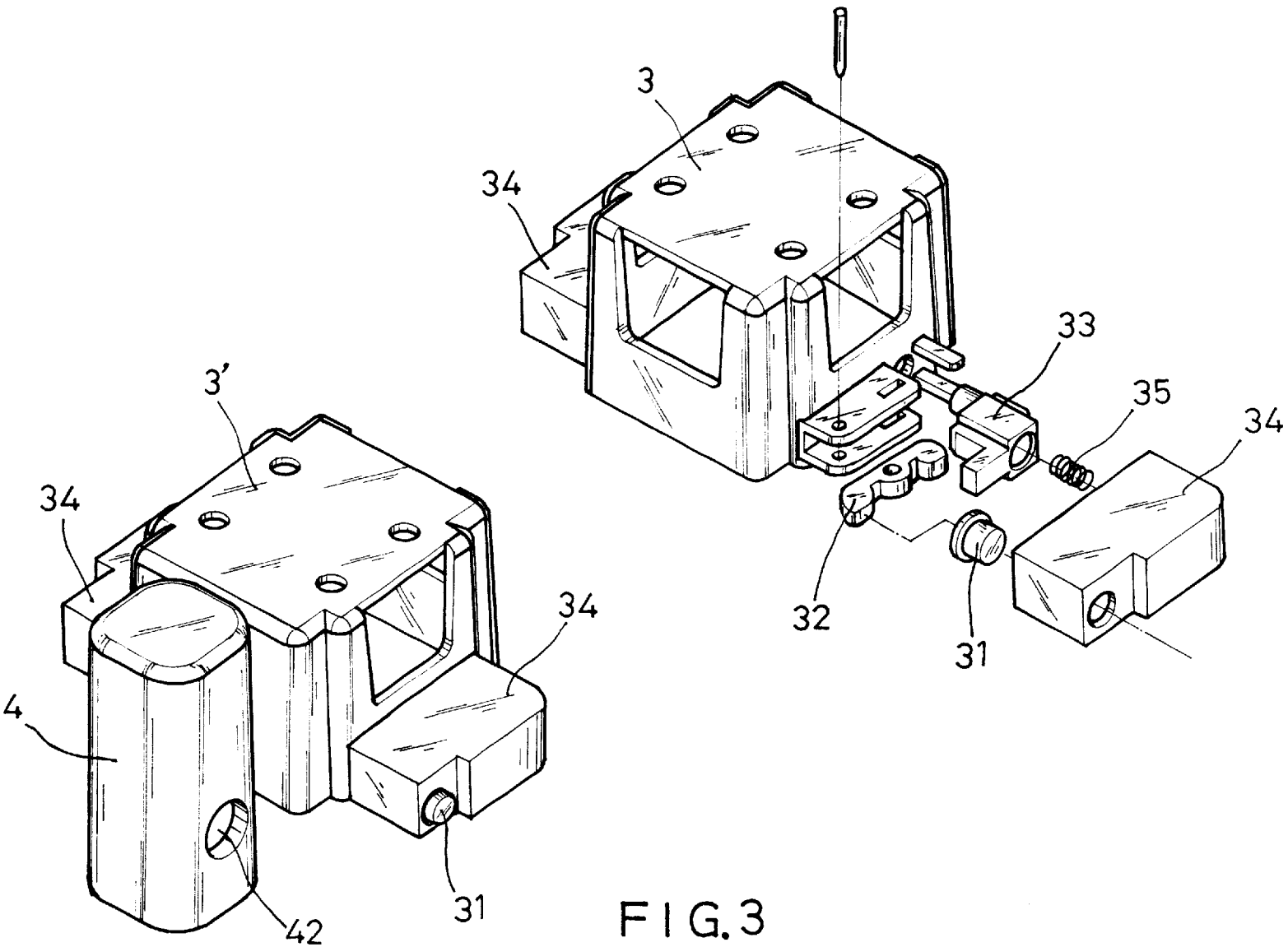
FIG. 3 illustrates the structure of the front wheel holder, the rear wheel holder, and the stop holder according to the present invention.
Figure 4:
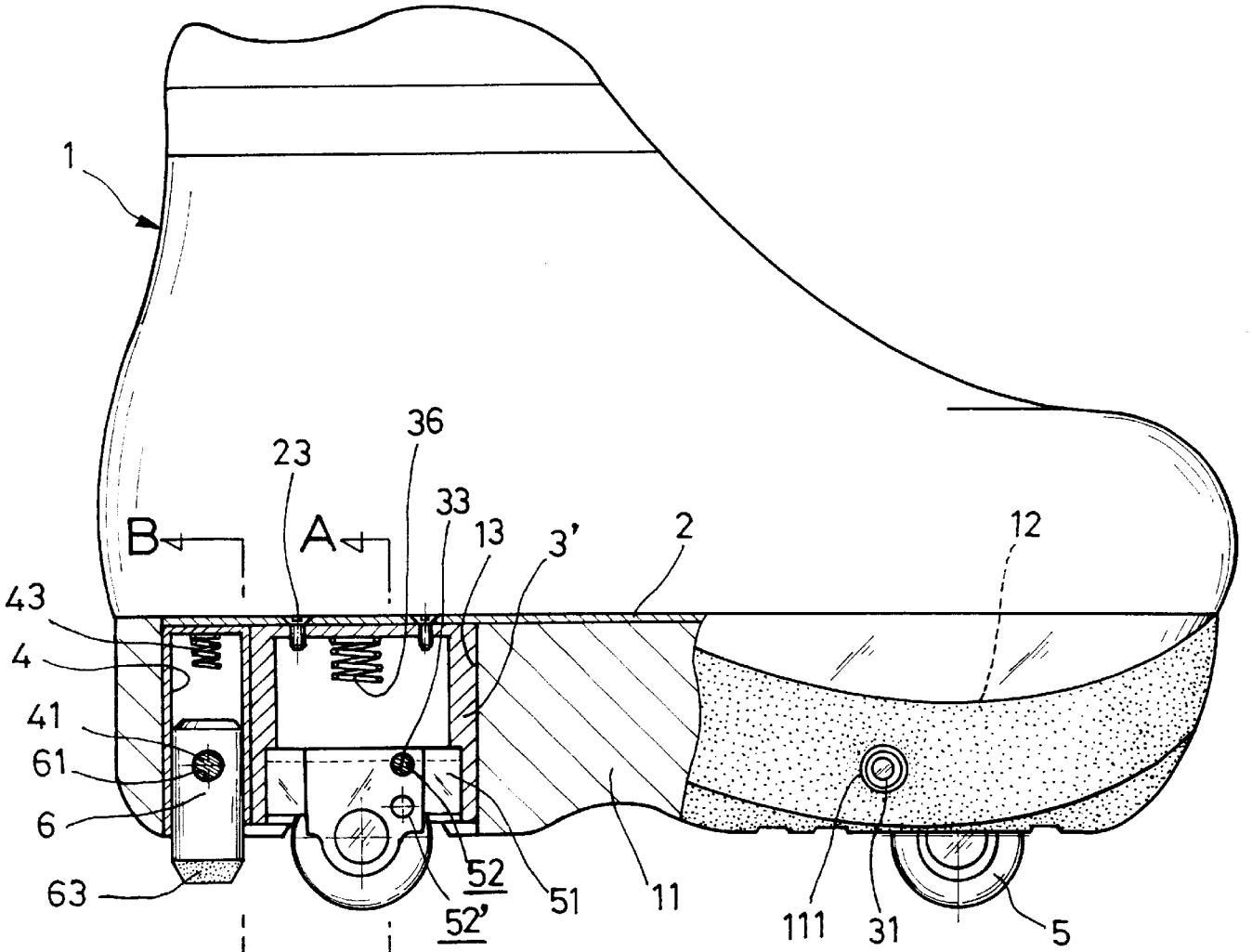
FIG. 4 is a sectional view of the present invention showing the wheel assemblies and the stop set in the extended position.
Figure 5:
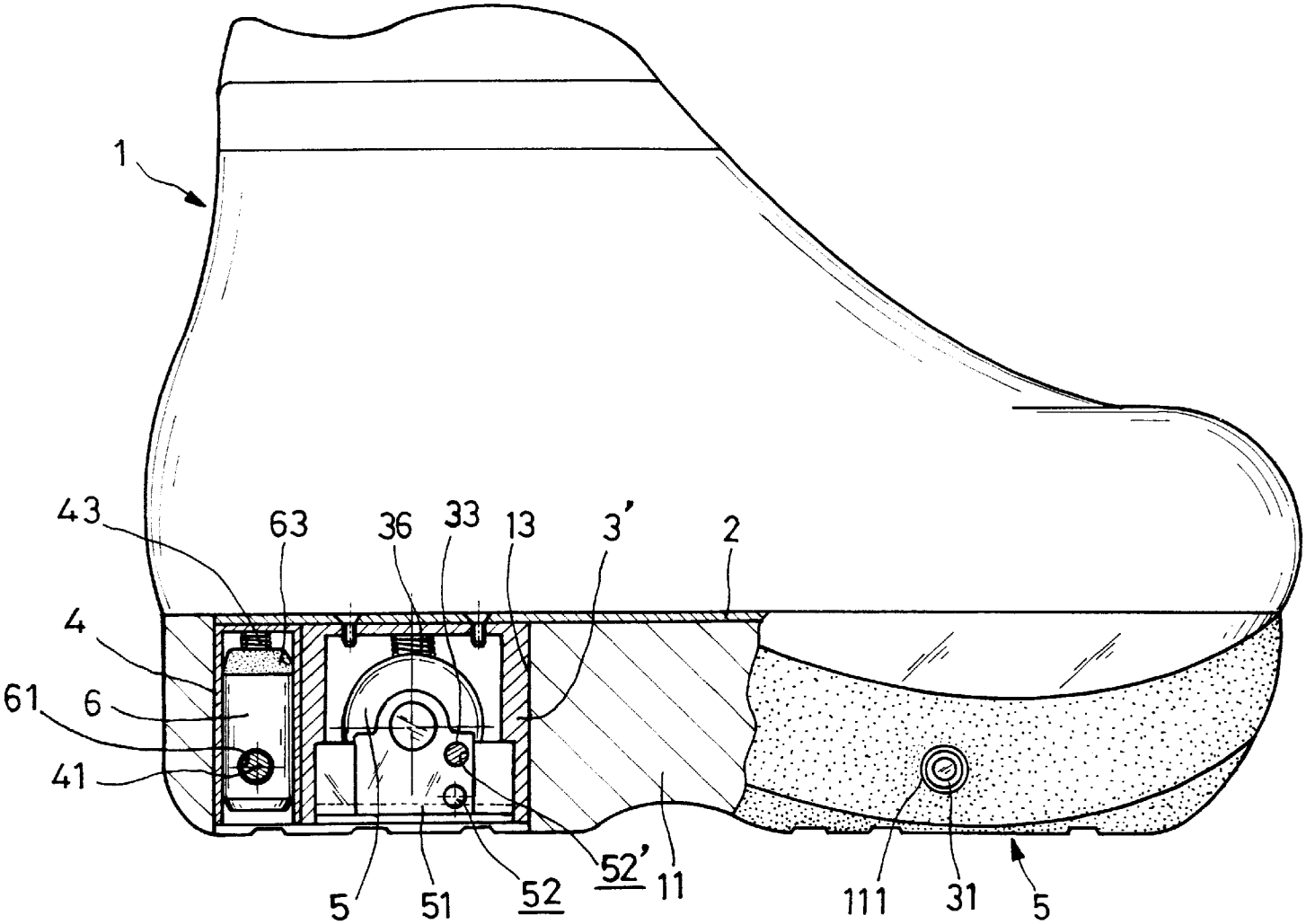
FIG. 5 is a sectional view of the present invention showing the wheel assemblies and the stop set in the received position.
Figure 6:
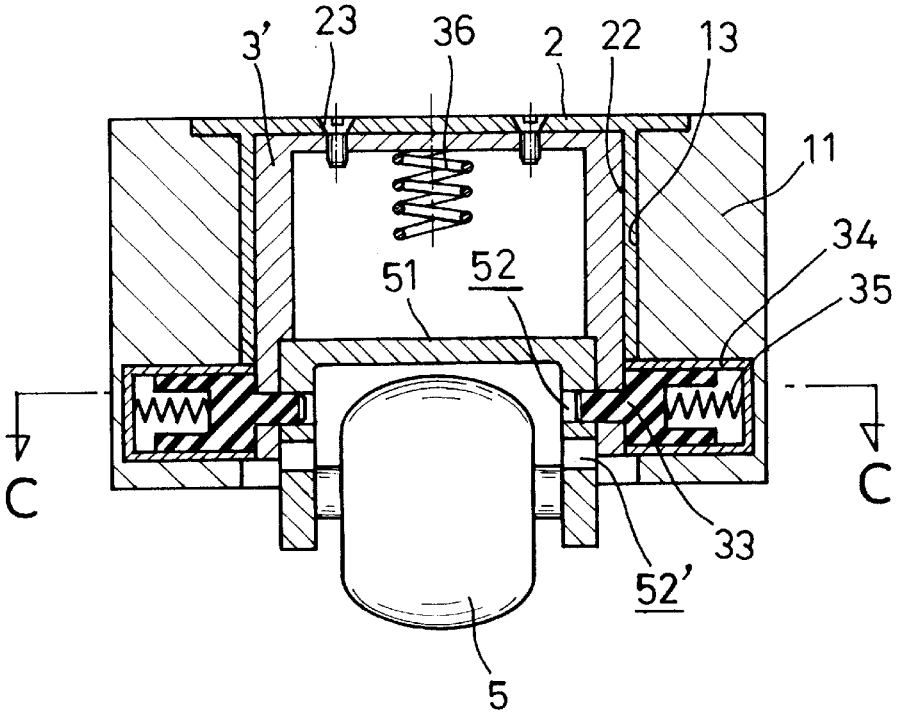
FIG. 6 is a sectional view taken along line A—A of FIG. 4.
Figure 7:
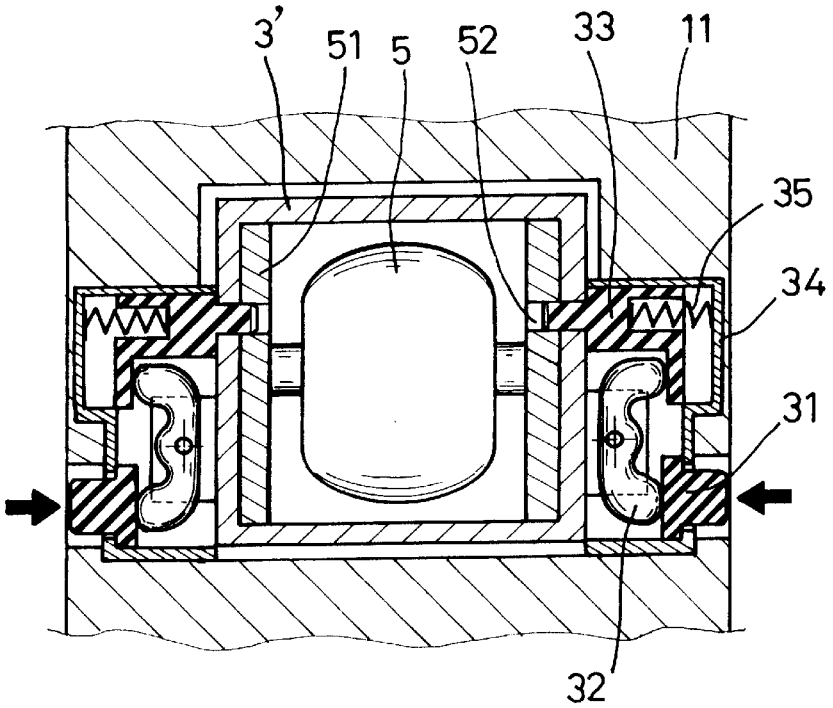
FIG. 7 is a sectional view taken along line C—C of FIG. 6.

Referring to FIGS. 2 through 7, the boot, referenced by 1, has an outsole 11 of a certain thickness. The outsole 11 comprises a front receiving chamber 12 and a rear receiving chamber 13 respectively extended through top and bottom sidewalls thereof, two transverse button holes 111 respectively extended through the two opposite lateral sidewalls thereof across the receiving chambers 12 and 13, and a transverse pin hole 112 disposed near the rear side thereof. A sole plate 2 is mounted on the outsole 11 and covered over the receiving chambers 11 and 12. The sole plate 2 comprises a front locating frame 21 fitted into the front receiving chamber 12 of the outsole 11, and a rear locating frame 22 fitted into the rear receiving chamber 13 of the outsole 11. A front wheel holder 3 and a rear wheel holder 3' are respectively fastened to the front locating frame 21 and rear locating frame 22 of the sole plate 2 by screws 23. Two wheel assemblies 5 are respectively insertable into the wheel holders 3 and 3'. The wheel assemblies 5 each comprise an inverted U-shaped frame 51 holding a wheel, The inverted U-shaped frame 51 has two vertically spaced pin holes 52, 52'. The wheel holders 3 and 3' each comprise two positioning caps 34 disposed at two opposite lateral sides, two lock pins 33 adapted to engage into one of the pin holes 52, 52' of the frame 51 of the respective wheel assembly 5 from two sides, two compression springs 35 respectively stopped between the lock pins 33 and the positioning caps 34 to force the lock pins 33 into one pin hole 52, 52' of the frame 51 of the respective wheel assembly 5, two buttons 31 respectively mounted in two ends of one button hole 111 of the outsole 11, and two pivoted levers 32 each having two free ends respectively connected to the lock pin. 33 and the buttons 31. When depressing the buttons 31 of one wheel holder 3 or 3', the levers 32 are turned to move the respective lock pins 33 out of the respective pin hole 52, 52' of the respective wheel assembly 5 against the respective compression springs 35, for enabling the respective wheel assembly 5 to be removed and reinserted in either the extended position, as shown in FIG. 4, or the received position, as shown in FIG. 5. When inserted in the received position, the inverted U-shaped frames 51 of the wheel assemblies 5 are disposed in an inverted position to close the receiving chambers 12 and 13 of the outsole 11 against dust.

Figure 8:
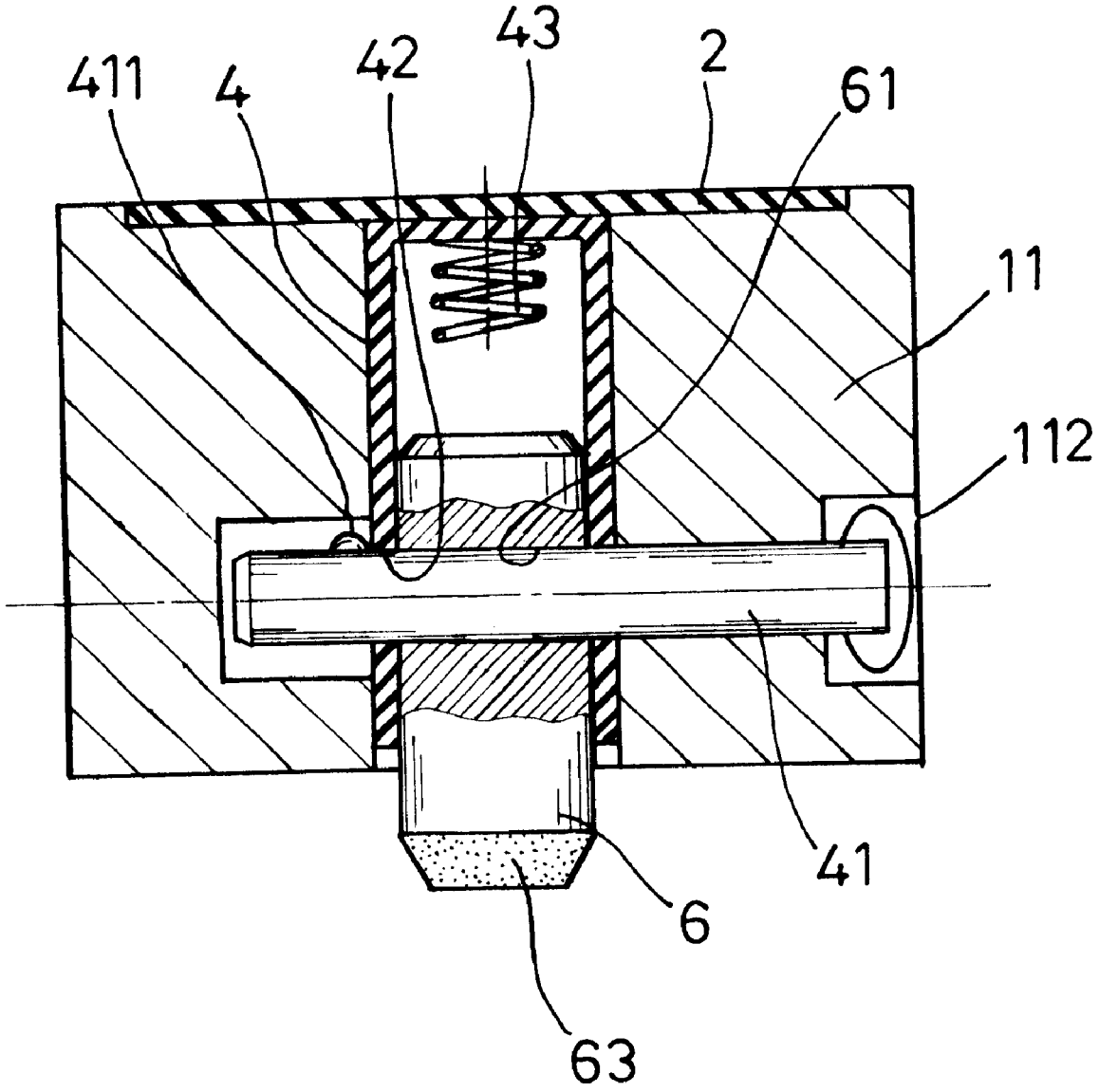
FIG. 8 is a sectional view taken along line B—B of FIG. 4.

Referring to FIG. 8 and FIGS. 2 through 4 again, a bottom-open stop holder 4 is formed integral with the rear wheel holder 3' and adapted to hold a stop 6. The stop holder 4 has two pin holes 42 aligned at two sides, The stop 6 has a transverse through hole 61, and a brake shoe of friction rubber 63 at the bottom end thereof. A pin 41 is mounted in the pin hole 112 of the outsole 11 and inserted through the pin holes 42 of the stop holder 4 and the transverse through hole 61 of the stop 6 to hold the stop 6 in the stop holder 4. The pin 41 has a spring-supported steel ball 411 disposed in a radial recessed hole thereof and partially protruding over the periphery for positioning. After installation, the steel ball 411 is stopped at one lateral sidewall of the stop holder 4. The transverse through hole 61 of the stop 6 is disposed near one end of the stop 6, so that the stop 6 can be mounted in the stop holder 4 in either of two directions, the extended (operative) position, as shown in FIG. 8, and the received (non-operative) position, as shown in FIG. 5.

Further, positioning springs 36 and 43 are respectively installed in the wheel holders 3 and 3' and the stop holder 4 to bias the wheel assemblies 5 and the stop 6 in the received, non-operative, position (see FIG. 5).

It is to be understood that the drawings are designed for purposes of illustration only, and are not intended for use as a definition of the limits and scope of the invention disclosed.

What the invention claimed is:

1. A roller skate comprising;

an outsole, said outsole comprising a front receiving chamber and a rear receiving chamber, each of said front and rear receiving chambers having two transverse button holes formed in opposing sides thereof and extending through said outsole, said outsole having a transverse pin hole disposed near a rear side thereof;

a sole plate mounted on said outsole, said sole plate comprising a front locating frame fitted into said front receiving chamber, and a rear locating frame fitted into said rear receiving chamber;

a front wheel holder disposed in said front receiving chamber and fastened to said front locating frame and a rear wheel holder disposed in said real receiving chamber and fastened to said rear locating frame of said sole plate;

two wheel assemblies respectively removably insertable into said front and rear wheel holders, each of said wheel assemblies being selectively oriented in one of a first orientation defining an extended position with a wheel extending out of a corresponding one of said front and rear receiving chambers of said outsole and a second orientation, said second orientation being inverted with respect to said first orientation and defining a received position for storing said wheel assembly in said corresponding one of said front and rear receiving chambers of said outsole;

two lock control means for releasably locking said wheel assemblies in each of said selected first and second orientation each said lock control means comprising two positioning caps disposed on opposing sides of a respective one of said front and rear wheel holders, two lock pins respectively disposed within said positioning caps and adapted to lock a corresponding one of said wheel assemblies, two compression springs respectively stopped between said lock pins and said positioning caps to force said lock pins into a locking position to lock said corresponding wheel assembly; two pivot levers respectively disposed within said positioning caps, and two buttons respectively mounted in said button holes of said outsole and adapted for operation by hand to force said pivoted levers to move said lock pins away from said corresponding wheel assembly for releasing said corresponding wheel assembly from said respective wheel holder to be selectively inverted and reinserted into said respective wheel holder;

a stop holder formed integral with said rear wheel holder;

a stop selectively insertable in said stop holder in one of a first position where said stop is received inside said rear receiving chamber and a second position where said stop is extended out of said outsole said outsole having a transverse pin hole disposed near a rear side thereof; and a locating pin mounted in the transverse pin hole of said outsole and adapted to releasably lock said stop in said selected position.

2. The roller skate of claim 1, wherein said wheel holders are respectively fixedly fastened to said sole plate by screws.

3. The roller skate of claim 1, wherein said wheel assemblies each comprise an inverted U-shaped frame holding the wheel, said inverted U-shaped frame having two vertically spaced pin holes on each of two opposing sides thereof adapted to receive the lock pills of a respective lock control means.

4. The roller skate of claim 1, wherein said locating pin is inserted through a transverse through hole of said stop and a transverse pin hole of said stop holder, said locating pin having a spring-supported steel ball disposed in a radial recessed hole thereof and being stopped at one lateral sidewall of said stop holder.

5. The roller skate of claim 1, wherein said stop has a bottom end fixedly mounted with a brake shoe made of friction rubber.

6. The roller skate of claim 1 further comprising a plurality of positioning springs respectively mounted in an upper end of said front wheel holder, an upper end of said rear wheel holder and an upper end of said stop holder each of said positioning springs being adapted to apply a bias force to a respective one of said wheel assemblies in said received position and said stop in said first position.

* * * * *